US007550908B2

(12) United States Patent
Arndt et al.

(10) Patent No.: US 7,550,908 B2
(45) Date of Patent: Jun. 23, 2009

(54) HOLDING DEVICE FOR FIXING A LAMP BULB AND ASSOCIATED LAMP

(75) Inventors: Joachim Arndt, Brieselang (DE); Uwe Fidler, Berlin (DE); Markus Herb, Gunzburg (DE)

(73) Assignee: Osram Gesellschaft mit beschraenkter Haftung, Munich (DE)

( * ) Notice: Subject to any disclaimer, the term of this patent is extended or adjusted under 35 U.S.C. 154(b) by 643 days.

(21) Appl. No.: 11/009,032

(22) Filed: Dec. 13, 2004

(65) Prior Publication Data

US 2005/0127807 A1 Jun. 16, 2005

(30) Foreign Application Priority Data

Dec. 12, 2003 (DE) ..... 103 58 361

(51) Int. Cl.
*H01J 5/48* (2006.01)
*H01J 5/50* (2006.01)

(52) U.S. Cl. ..... 313/318.1; 313/324; 313/318.04; 313/318.09; 313/238; 313/240

(58) Field of Classification Search .... 313/315–318.12, 313/323–324, 567–643, 238–292, 439, 49–51; 248/200
See application file for complete search history.

(56) References Cited

U.S. PATENT DOCUMENTS 4,623,958 A * 11/1986 Van der Linde et al. ..... 362/549
5,172,026 A * 12/1992 Hall et al. ..... 313/318.1
5,465,025 A * 11/1995 Hendrickson ..... 313/318.09
5,576,591 A 11/1996 Block et al.
5,711,596 A * 1/1998 Hoover et al. ..... 362/548
5,818,154 A * 10/1998 Helbig et al. ..... 313/318.01
6,075,318 A * 6/2000 Noll et al. ..... 313/573
6,319,046 B1 11/2001 Feye-Hohmann et al.
6,469,428 B1 * 10/2002 Thiel et al. ..... 313/318.09
7,119,484 B2 * 10/2006 Damm et al. ..... 313/318.01
2004/0130255 A1 * 7/2004 Mudra et al. ..... 313/318.08
2004/0183445 A1 * 9/2004 Kruger et al. ..... 313/635
2004/0239226 A1 * 12/2004 Westemeyer et al. ... 313/318.01
2007/0114942 A1 * 5/2007 Dekkers et al. ..... 313/634

FOREIGN PATENT DOCUMENTS

WO PCT/DE2004/001710 7/2004

* cited by examiner

*Primary Examiner*—Sikha Roy
*Assistant Examiner*—Jose M Diaz

(57) ABSTRACT

A holding device for fixing a lamp bulb comprises at least one clip element, the clip element, referred to as the main clip, having a peripheral flange as a supporting surface, which is adjoined at its inner rim by a peripheral side wall with a given height H, which is preferably cylindrically shaped, its free end forming a closing-off cover, the cover having a clearance which is adapted to the portion of the lamp bulb that is to be fixed.

3 Claims, 17 Drawing Sheets

HOLDING DEVICE FOR FIXING A LAMP BULB AND ASSOCIATED LAMP

TECHNICAL FIELD

The invention relates to a holding device for fixing a lamp bulb and to an associated lamp. Here it concerns in particular high-pressure discharge lamps, preferably metal halide lamps, but also for example halogen incandescent lamps. Often a longitudinally extended, in particular ceramic, discharge vessel is used as the lamp bulb. Details of a lamp of this type are disclosed in the still unpublished PCT/DE2004/001710 which is incorporated by reference.

BACKGROUND ART

U.S. Pat. No. 5,576,591 already discloses a holding device for fixing a lamp bulb and associated lamp which is made up of three bulbs. It has a ceramic adapter, which is mounted on a screw base. Atmospheric pressure prevails between the enveloping bulb and the outer bulb.

U.S. Pat. No. 6,319,046 describes a high-pressure lamp with a base at one end in which the outer bulb is surrounded by a reflector. The base is fastened directly to the neck of the reflector by means of crimping. A disadvantage of this is that the dimensioning of the neck of the reflector must also be made to match the standard dimensions of the base.

DISCLOSURE OF THE INVENTION

It is an object of the present invention to provide a holding device for fixing a lamp bulb which is simple to mount and can be produced well in an automated process.

This object is achieved by the following features: the holding device comprises at least one clip element, often referred to hereafter as the main clip, the main clip having as a supporting surface a circular ring as a peripheral flange with an inner rim and an outer rim, the inner rim of which is adjoined, in section approximately transversely to it, by a peripheral side wall with a given height H, which is preferably cylindrically shaped, the free end of which forms a closing-off cover, the cover having a clearance, which is adapted to a portion of the lamp bulb that is to be fixed, and which has in particular a means for an anti-twisting mechanism.

Particularly advantageous refinements can be found in the dependent claims.

The invention makes possible the fixing of the lamp bulb of a lamp pinched at one end by means of a holding device, also known as a holding element, the holding function of which is realized either by a form fit or by spring force. Particularly suitable for this is a spring clip which is designed as a clip mechanism. This makes the lamp particularly suitable for simple mechanical production appropriate for automated equipment on production lines without hot processes, such as for example sealing-in, welding or soldering. Moreover, long process times, for example for drying, baking or pumping, are avoided. The lamp bulb is fixed without cement, by means of two clips, preferably made of metal or else plastic.

Previously, the supply leads to the lamp bulb were welded directly to the components of the frame. Evacuation of the outer bulb, or filling it with inert gas, is necessary to protect the metallic parts of the frame from oxidation.

A lamp bulb with at least one end portion, usually a pinch or seal, is inserted in a holding element, for example a clip mechanism, preferably made of metal, and held by a form fit or spring force. The holding element comprises one element, but particularly preferably two elements. A holding element comprising one part must be suitably shaped to prevent tipping over of the bulb by means of component parts that protrude out of a plane. On the other hand, in the case of a holding element comprising two parts, there is no limit to the design possibilities for simple means of preventing the bulb from tipping over. In this case, reference is made hereafter to a first part as the main clip and a second part as the secondary clip or auxiliary clip.

At least one of the clip elements, that is the main clip, resembles a hat with a drawn-up region as a side wall, preferably cylindrical, and a peripheral flange, which serves as a supporting rim. An anti-twisting mechanism is incorporated in the flange. This comprises in particular anti-twisting zones, which are formed as notches or clearances in the flange. Alternatively, at least one depression or dent and/or elevation or bulge could be provided. Provided in the cover, that is the upper termination of the drawn-up part, is a clearance which corresponds to the lamp bulb and the receiving geometry of which is adapted to that of the end portion. In particular, the cover contains spring elements or form-fitting elements as edges of the clearance for the pinch zone of the lamp bulb.

The second clip, that is the secondary clip, is typically of a similar construction to that of the main clip, but its side wall is lower.

In individual cases, it is possible for the secondary clip to comprise only a flange and the cover integrated in it, the receiving geometry that corresponds to the lamp bulb being retained for the end portion of the lamp bulb. This is therefore a clip without a side wall. If both clip elements have a side wall, the height of the side wall of the secondary clip is always less than the height of the side wall of the main clip. Normally, the diameter of the secondary clip is also slightly less than that of the main clip, to allow the two parts to be joined better. This is the simplest way of achieving the effect that the two clip elements can be fitted one into the other. The joined clip mechanism may be designed both as detachable and non-detachable, for example laser-welded. Joining the clip elements produces a defined, parallel distance between the receiving plateaus, caused by the flanges serving as supporting surfaces. This distance is chosen such that the spring elements of the clip mechanism rest on the surface of the end portion which they surround, usually a pinch surface of the lamp bulb to be joined. In this case, a specific safety clearance from the supply leads is to be maintained for the clip element that is closer to the outer supply leads of the lamp bulb, that is the secondary clip.

The combination of the two clip elements joined in this way is placed onto an insulating mount, preferably a ceramic adapter, the mount having anti-twisting means corresponding to the anti-twisting mechanism of the clip elements. In this case, the anti-twisting zones that are provided in the clip elements are for example inserted into the adapter ceramic by means of corresponding elevations or depressions.

In the case of, for example, a lamp which uses as the enveloping part an outer bulb or a reflector, the enveloping part preferably consists of glass, or in the case of a reflector lamp, of aluminium, in which case it is provided with a reflector contour.

The enveloping part rests on the flange of the clip elements and is connected to the mount/adapter in a manner which is secure with respect to twisting by means of a clamping strip, for example a flanged ring, preferably of aluminium. The flange of the clip combination that lies between the enveloping part and the mount, or in fact the adapter ceramic, is likewise fixed by the forming on of the flanged ring.

The base, preferably made of metal, is advantageously fixed on the mount, which serves as a base contact insulator, by deforming. The electrical contacting between the outer supply lead of the lamp and the base contacts is preferably established by an extension piece of a suitable conductor material. The connections are established by deforming or clamping.

A preferred application is in a lamp with a base at one end which has a lamp bulb closed off in a vacuum-tight manner, in particular a longitudinally extended discharge vessel, which under some circumstances is still accommodated in an outer bulb, the lamp bulb, that is the discharge vessel or else the structural unit comprising the discharge vessel with the outer bulb, still being surrounded by an enveloping part. This is preferably a ceramic discharge vessel, in particular for a metal halide lamp, for example for general lighting purposes. In this case, a base with electrical terminals carries on the one hand the lamp bulb and on the other hand the enveloping part. The electrical terminals are normally connected to supply leads, which establish an electrical contact with a luminous means in the interior of the lamp bulb, for example if the luminous means is realized by electrodes or a luminous body of an incandescent lamp. Without restricting the invention, external electrodes can also be used, or a configuration which does not have any electrodes. Instead of a ceramic discharge vessel, a discharge vessel made of quartz glass or hard glass may also be used. An outer bulb is not absolutely necessary. In this case, the combination of the following features is used, so that there is no need for laborious frame assembly and hot processes such as sealing-in, baking of the base cement:

a) the base has a base contact insulator produced from insulating material, which has a central opening;
b) the base contact insulator has a radially projecting segment, which is in particular circular, with an associated upper and lower plateau with respect to the base;
c) the enveloping part has on the base side an opening, in particular circular, with a radially projecting rim or rim portion, which has a lower and upper contact surface with respect to the base, the lower contact surface of the rim or rim portion fitting together with the upper plateau of the radially projecting segment on the base contact insulator;
d) the enveloping part is fastened to the base by a cement-free mechanical holding mechanism.

In particular, in a first embodiment, the enveloping part is fastened by a clamp part bridging the distance between the lower plateau of the base contact insulator and at least the upper contact surface of the rim in a securing manner.

In a second embodiment, the enveloping part and the clamp part can form a unit, the securing of the enveloping part being realized in the upper part of the base contact insulator, for example by crimping.

Apart from the base contact insulator, the base has a customary part which faces the holder, for example a screw base attachment or a bayonet base attachment.

According to the invention, the lamp bulb, that is for example the outer bulb or the discharge vessel in the case of no outer bulb, is secured in the central opening of the base contact insulator by means of a special holding element attached on the base contact insulator, in particular a spring clip.

In particular, the rim of the enveloping part and the segment of the base contact insulator are provided with an interacting anti-twisting mechanism.

A simple, reliable and low-cost solution for the securing of the enveloping part is that the clamp part comprises clamps distributed over the circumference or a peripheral clamp strip. In particular, the clamp strip is a deformable ring, which is produced in particular from metal or plastic, so that a very simple securing is possible by the clamp strip first being already angled away at the lower rim, and being drawn up over the base contact insulator until it comes up against the projecting segment. As soon as the enveloping part is fitted on, the ring, preferably made of aluminium, can be mechanically formed onto the segment, and in this way fix the rim of the enveloping part.

A damping means is preferably inserted between the clamp part and the upper contact surface of the rim of the enveloping part. This is in particular a kind of O-ring, for example made of an elastomer. In this way, the material of the enveloping part, advantageously glass or aluminium, is protected from being damaged during the forming-on process. A further advantage is that, as a result, the connecting force between the enveloping part and the segment is retained without any play over the service life of the lamp. On account of the damping ring, the clamping of the clamp part can be increased without any risk, and consequently the connection can be made more reliable.

Supply leads, which are connected to the electrical terminals of the base, are usually led out from the lamp bulb. A particularly flexible and time-saving solution is to use clamping connections, such as are known per se for example from U.S. Pat. No. 6,319,046 , for the connection between the electrical terminals and the supply leads.

Usually, the base also has a part facing the holder, which is at least partly connected to the base contact insulator as known per se by means of crimping. This part contains for example a customary screw thread.

The enveloping part may be, for example, a closed part such as a further outer bulb, though not closed off in a vacuum-tight manner, or else a spherical cap which has a reflector contour.

A typical application is a metal halide lamp which contains a filling with or without a mercury component, if appropriate with inert starting gas, advantageously noble gas.

BRIEF DESCRIPTION OF THE DRAWINGS

The invention is to be explained in more detail below on the basis of several exemplary embodiments. In the drawing.

BEST MODE FOR CARRYING OUT THE INVENTION

Figure 1A:
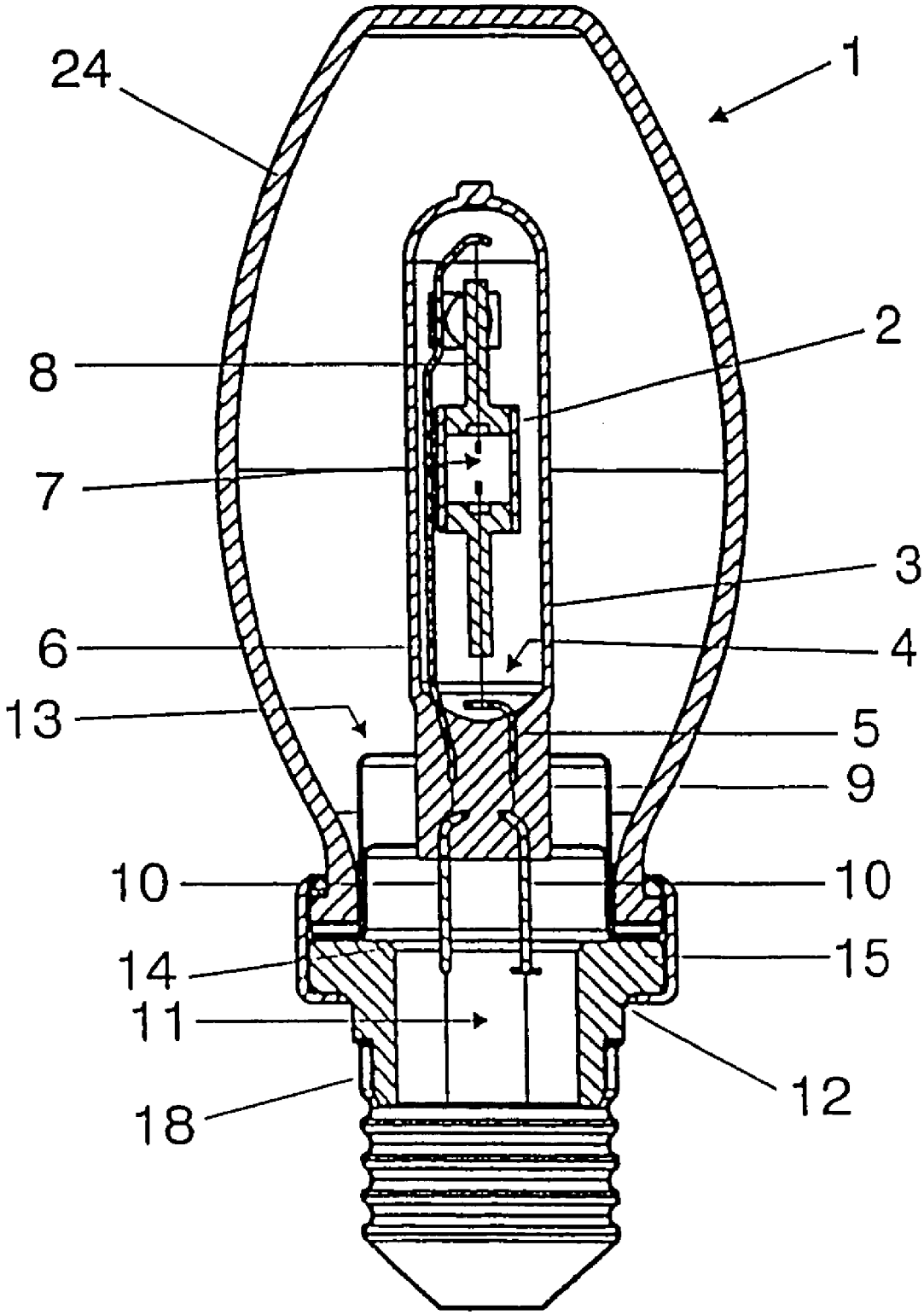
FIG. 1 shows a metal halide lamp in side view (FIG. 1*a*) and in a side view turned by 90° (FIG. 1*b*)
Figure 1B:
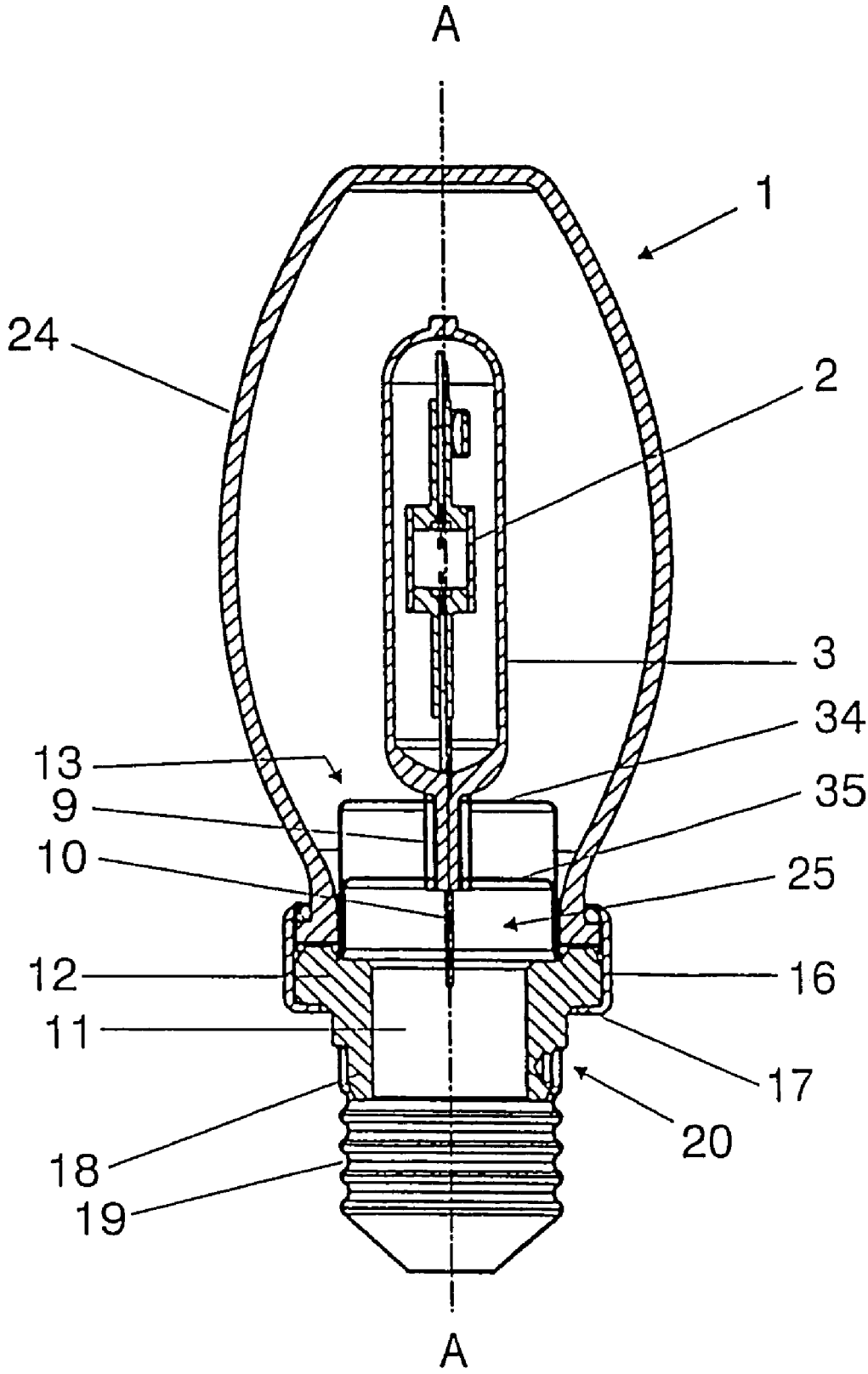
Figure 2A:
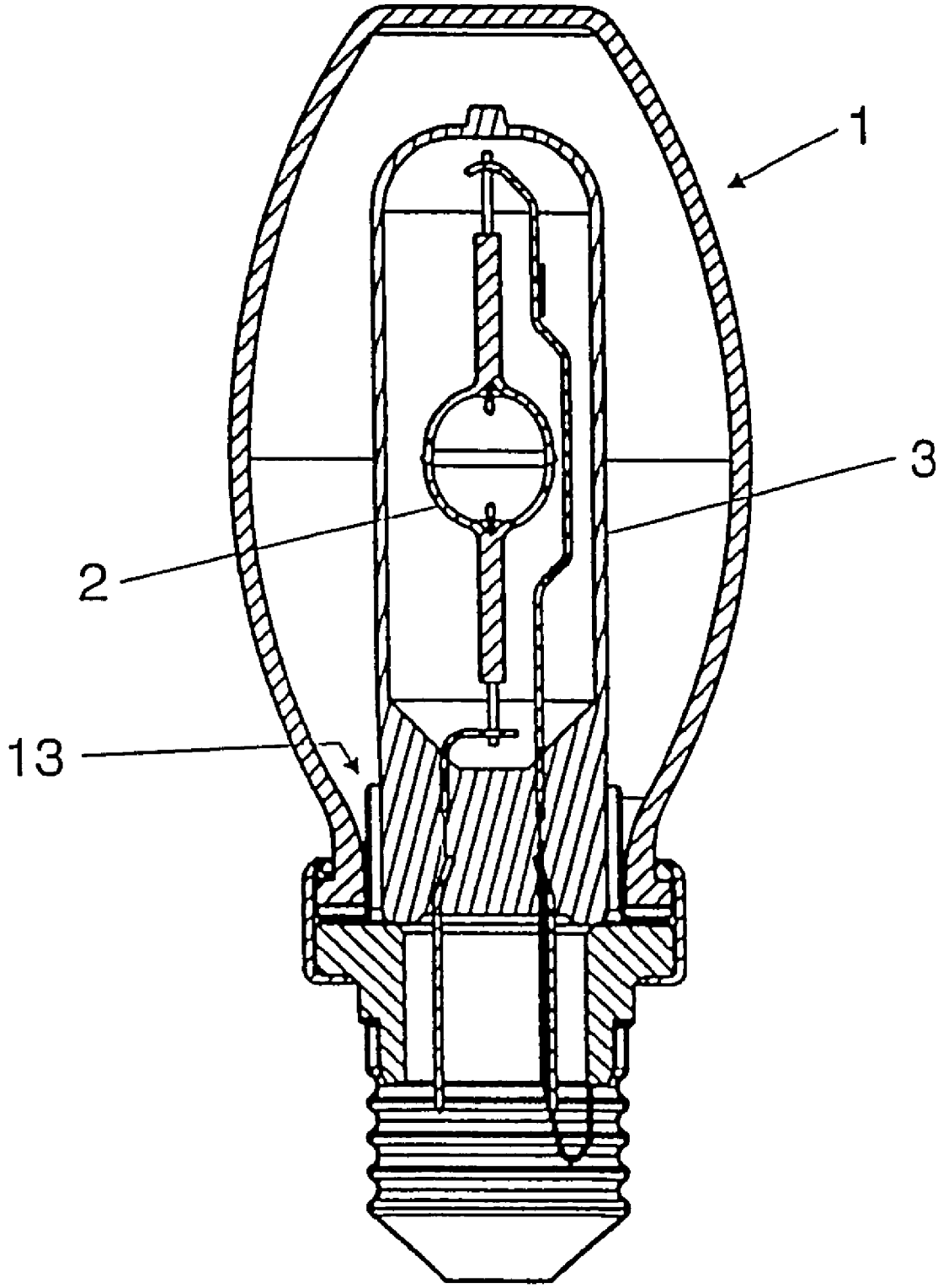
FIG. 2 shows a second exemplary embodiment of a lamp in side view (FIG. 2*a*) and in a side view turned by 90° (FIG. 2*b*)
Figure 2B:
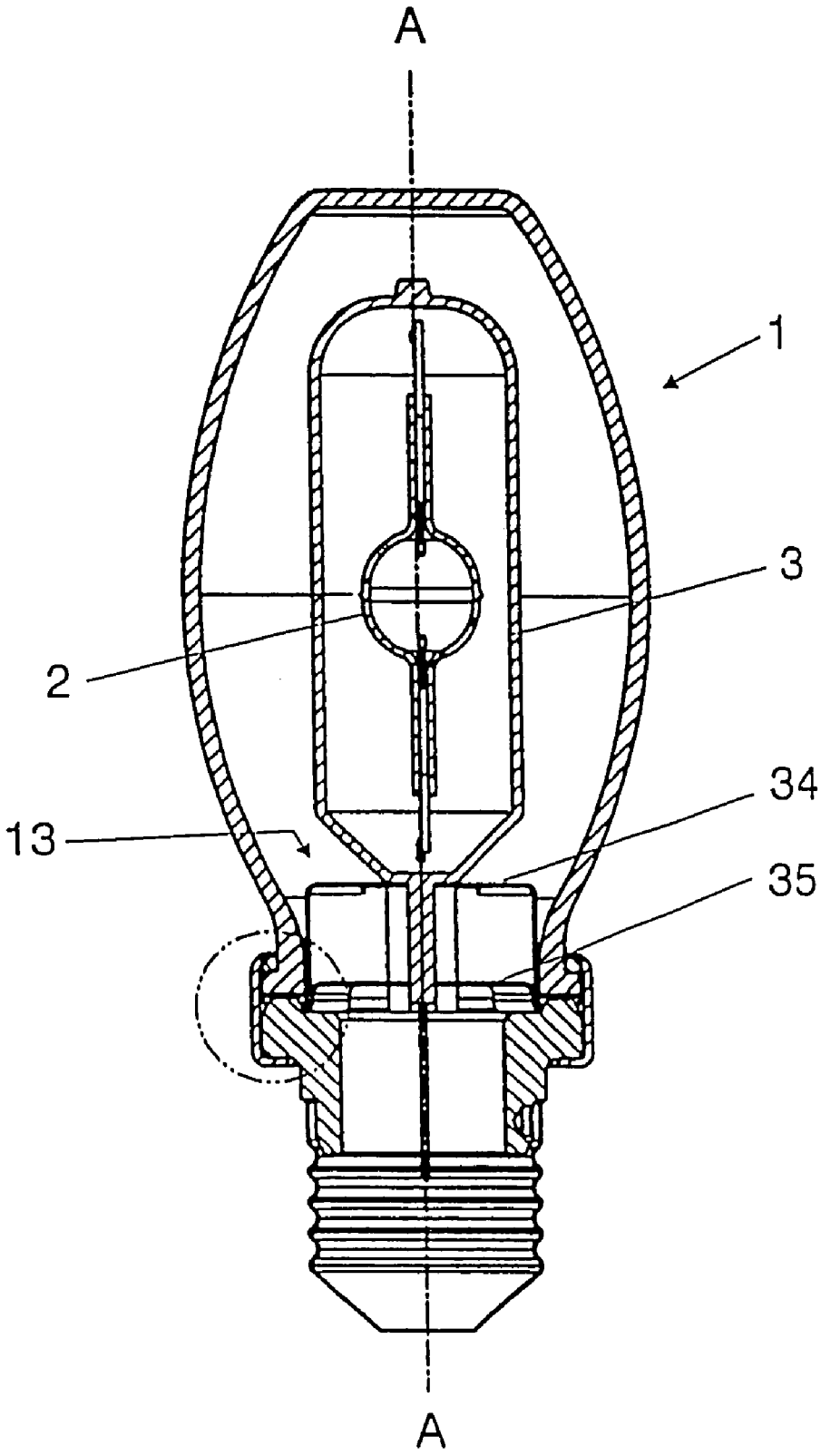

FIGS. 1 and 2 show an exemplary embodiment of a metal halide lamp 1, respectively turned by 90° with respect to each other. A ceramic discharge vessel 2, which is closed at two ends, is arranged in a longitudinally extended manner in the lamp axis A. It is closely surrounded by an outer bulb 3, which is pinched at one end and is produced from hard glass or quartz glass. A frame 4 with short and long leads 5, 6 secures the discharge vessel 2 in the outer bulb 3. The electrodes 7 inside the discharge vessel are connected to the leads 5, 6 by means of lead-throughs 8. Said leads are connected in the region of a pinch 9, which seals the outer bulb 3, to external supply leads 10. The pinch 9 of the outer bulb is located above a hollow space 11 of a base contact insulator 12 made of ceramic and is secured by a holding element 13 made of metal. The base contact insulator may also be produced from some other material, for example a plastic which can withstand great loading.

The holding clip 13 protrudes out of a plane of the base contact insulator, which forms an upper plateau 14 of a radially projecting disk-shaped segment 15. The segment 15 is configured furthermore with a side wall 16 and a lower plateau 17. It is located on a neck part 18, which secures a part assigned to the holder, here a screw base part 19 with a thread. The screw base 19 is fastened to the neck part 18 by means of crimping 20. In the opening 11 of the neck part 18, the supply leads 10 are connected to electrical terminals 21 of the base of the neck part (not visible). Other mechanical connecting techniques or a customary welded connection or an insulation-piercing connection are also similarly suitable.

Figure 4:
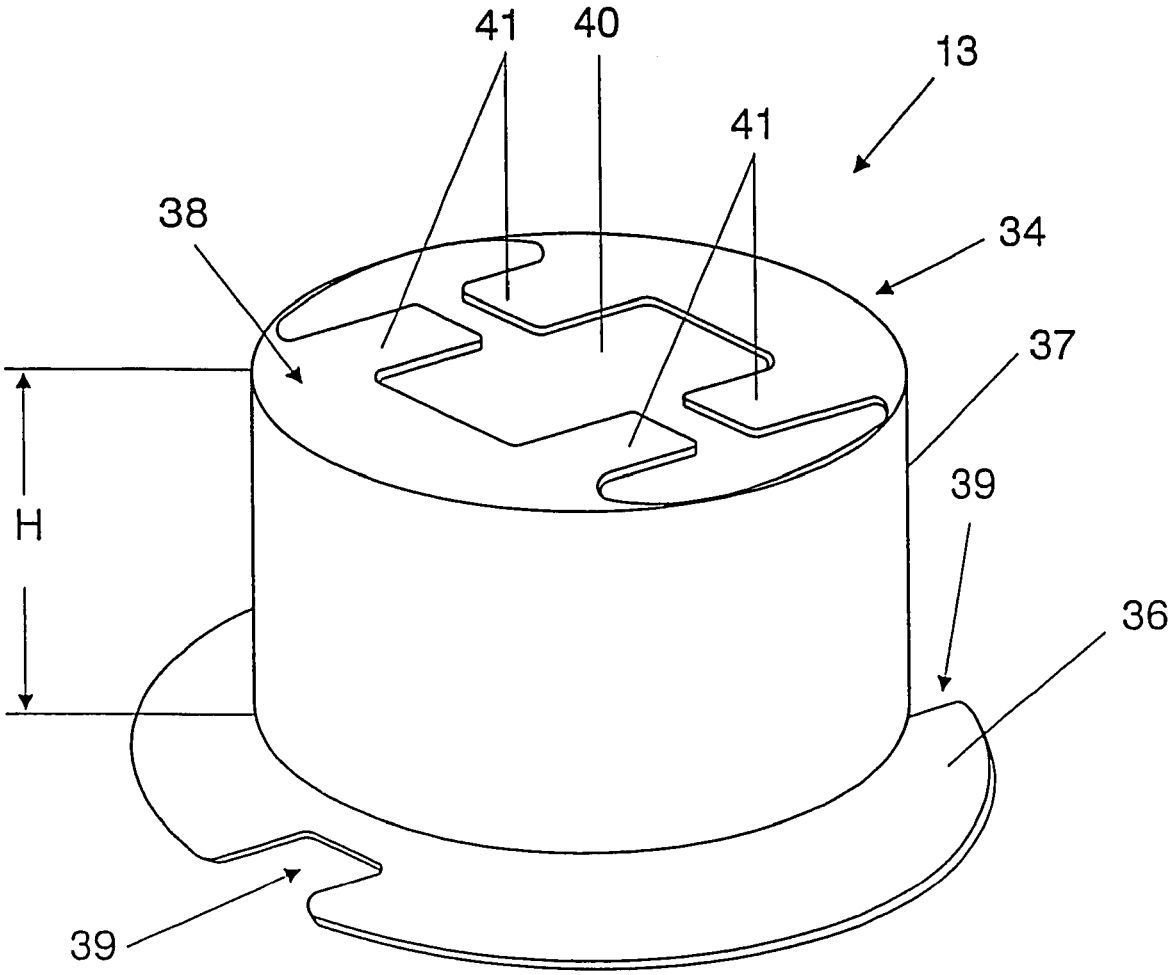
FIG. 4 shows a first embodiment of the main clip.
Figure 5:
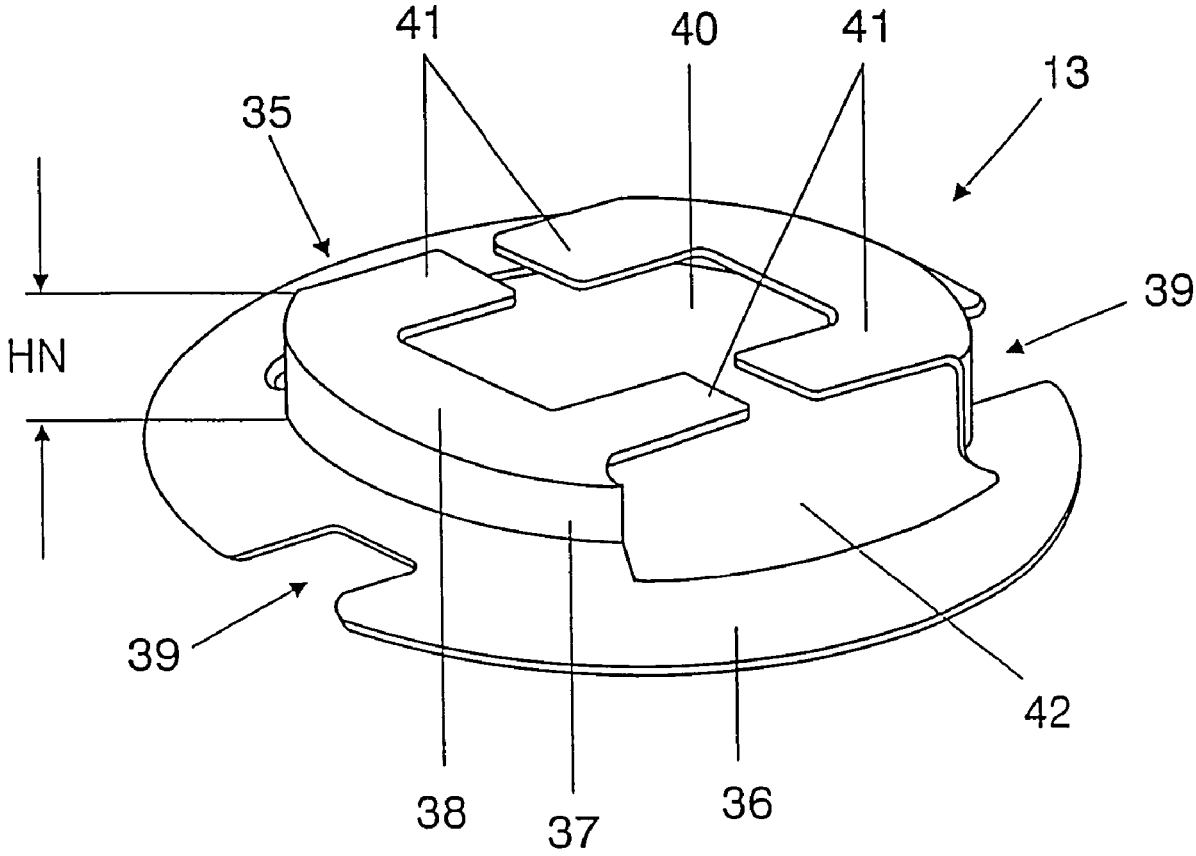
FIG. 5 shows a first embodiment of the secondary clip.

The holding element 13 is formed in two parts and, as shown in the detail in FIGS. 4 and 5, comprises two joined spring clip elements, that is the main clip 34 and the secondary clip 35 located under it. Both are constructed in the manner of a cylindrical hat. They respectively have a peripheral flange 36, a side wall 37 adjoining their inner rim and a cover 38 closing off their free end.

Figure 13:
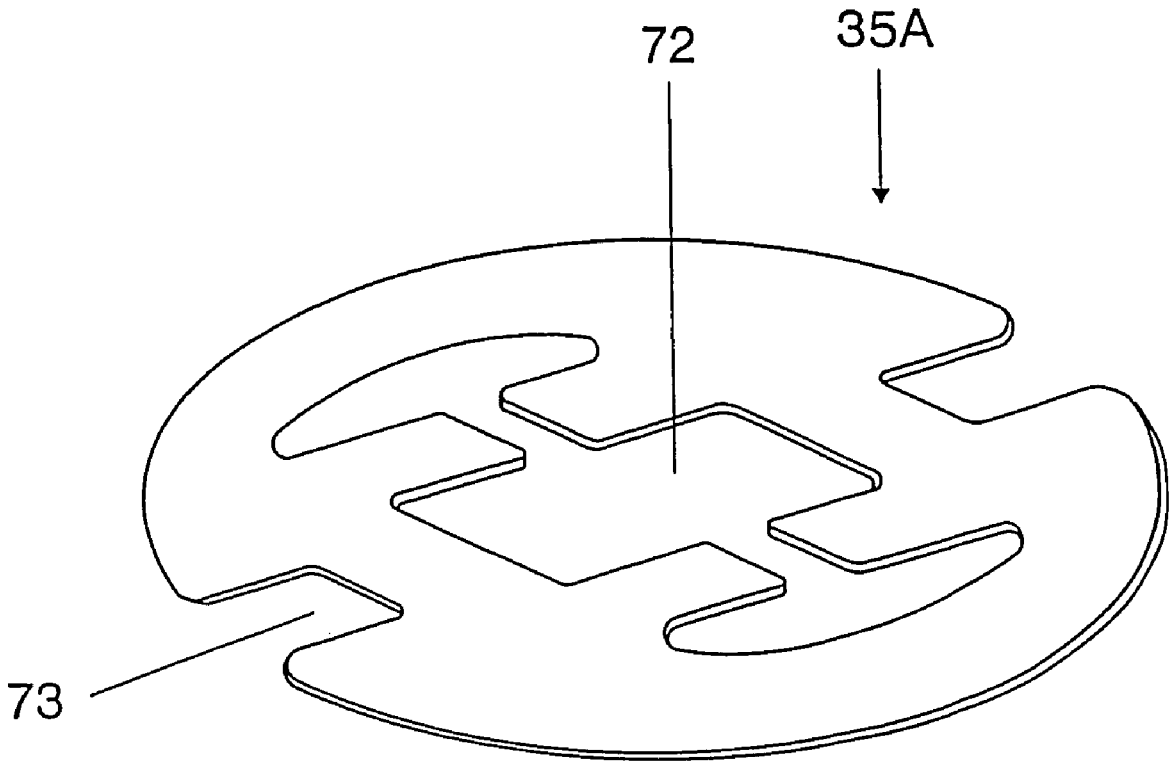
Figure 14:
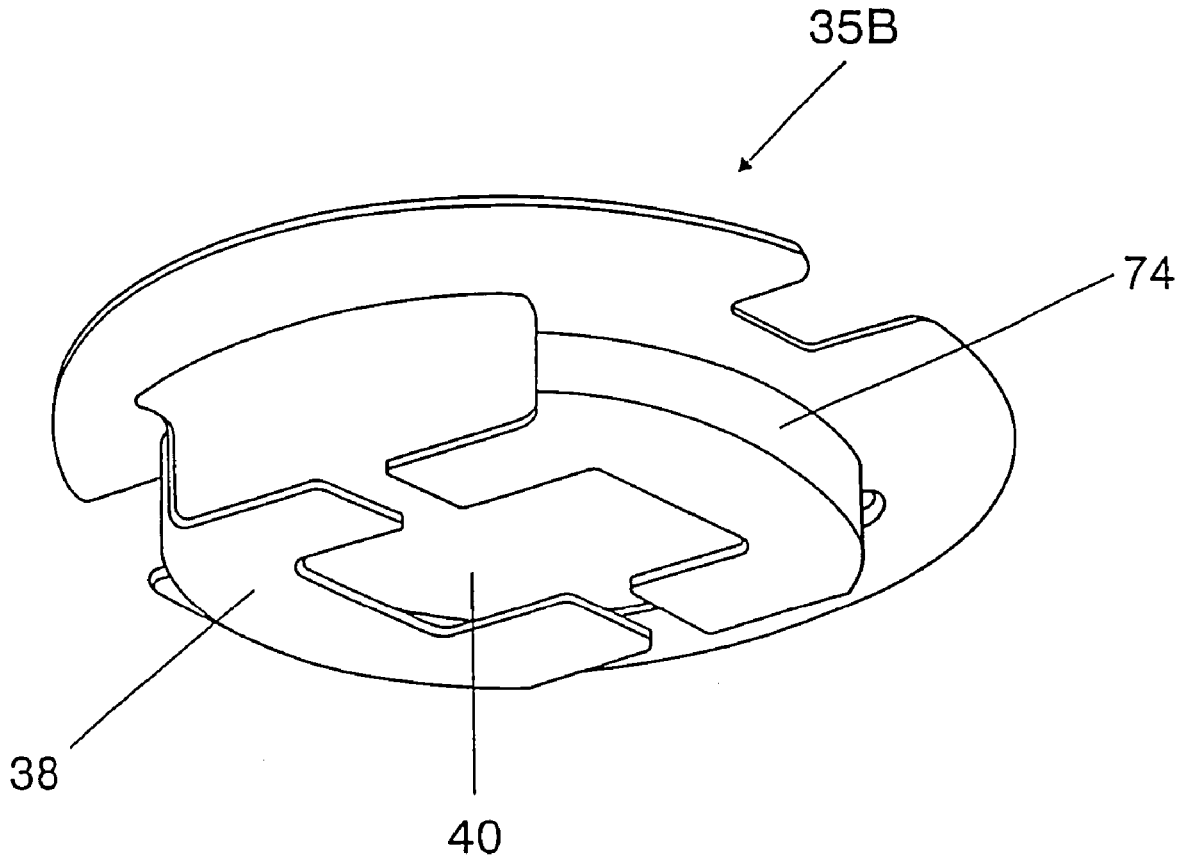

The main difference between the main clip 34 and the secondary clip 35 is the different height of the side wall 37. In the case of the main clip, in which the height H of the side wall is typically one to two cm, it is much greater than in the case of the secondary clip, in which the height HN of the side wall is typically much less, and in particular a few mm, for instance 3 to 6 mm. Under certain circumstances, the side wall of the secondary clip is dispensed with entirely. The height of the side wall is generally based on the light center to be set of the bulb to be inserted into the holding element. In this respect it may be possible that the secondary clip 35A does not require the side wall for setting a desired light center, that is to say represents a flat disk 71 with a corresponding clearance 72 and anti-twisting means 73, see FIG. 13. In the case of a low light center, negative values may also be required for the height of the side wall, see FIG. 14, i.e. the side wall 74 extends in the opposite direction, that is into the opening 11 of the base contact insulator.

Both elements have an anti-twisting mechanism, which in the exemplary embodiment shown is realized in a clearance 39 which is punched out approximately rectangularly in the flange; both elements have this clearance twice in an identical form.

Both elements, again also see FIGS. 4 and 5 in this respect, also have an approximately rectangular clearance 40 in the cover, which is adapted to the pinch 9 of the outer bulb. Four spring tongues 41 respectively protrude into the clearance 40 and can consequently fix the I-shaped pinch 9. A part 42 of the side wall that adjoins the clearance may be removed for reasons of simplification, as shown in FIG. 5.

Shown in FIG. 2 is a further exemplary embodiment of a lamp, the main difference of which is the different height of the cover of the secondary clip. A detail is shown in FIG. 3.

An enveloping bulb 24, which surrounds the outer bulb 3 at a relatively great distance, has a base-side opening 25, which is circular-cylindrical and is adapted in diameter to the outside diameter of the segment 15. Between the two parts, which are adapted to each other in shape and dimensions, there may also be inserted a buffer part 26 (depicted by dashed lines in FIG. 3), which may for example be a silicone sleeve.

Figure 3:
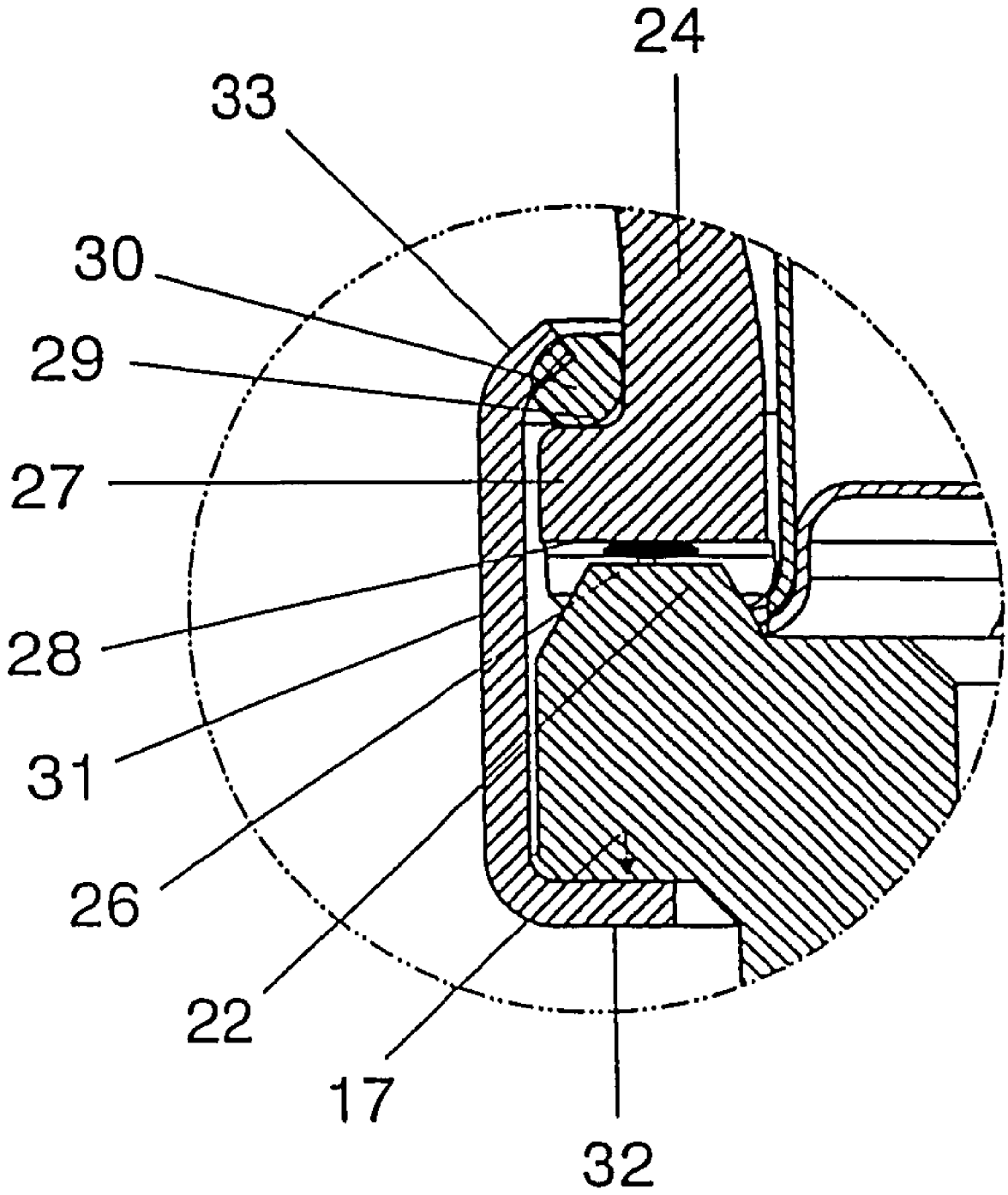
FIG. 3 shows an enlarged detail of the lamp before final fastening.

The enveloping bulb 24, also see FIG. 3 in this respect, is provided at its opening 25 with a radially projecting rim 27. It has a planar lower contact area 28, which is adapted to the upper plateau 14 of the segment of the base contact insulator. The upper plateau may have bumps 22, which bring about the effect of keeping the upper plateau 14 at a distance from the enveloping bulb 24. Furthermore, it has a narrow upper contact area 29, which is aligned parallel to the lower contact area 28 or else obliquely in relation to it. Located on it is an elastomer ring 30, for example made of Viton®.

FIG. 3 shows this region enlarged, once a clamp part is fastened. Represented is a clamp ring comprising an aluminium strip 31, the lower rim 32 of which is angled away by approximately 90°, so that the strip 31 has been pushed on until it comes up against the lower plateau 17 of the segment, serving as a stop. The clamp effect is achieved by the upper rim 33, which was at first aligned straight, being subsequently rolled on by force being expended, so that it rests on the elastomer ring 30. The connecting force has the effect that the enveloping bulb 24 is pressed against the upper contact area 29 of the rim 27 by means of the elastomer ring 30 with stress, which leads to deforming of the ring 30.

The main clip 34 explained above is shown in detail in FIG. 4.

The secondary clip 35 explained above is shown in detail in FIG. 5.

Figure 6:
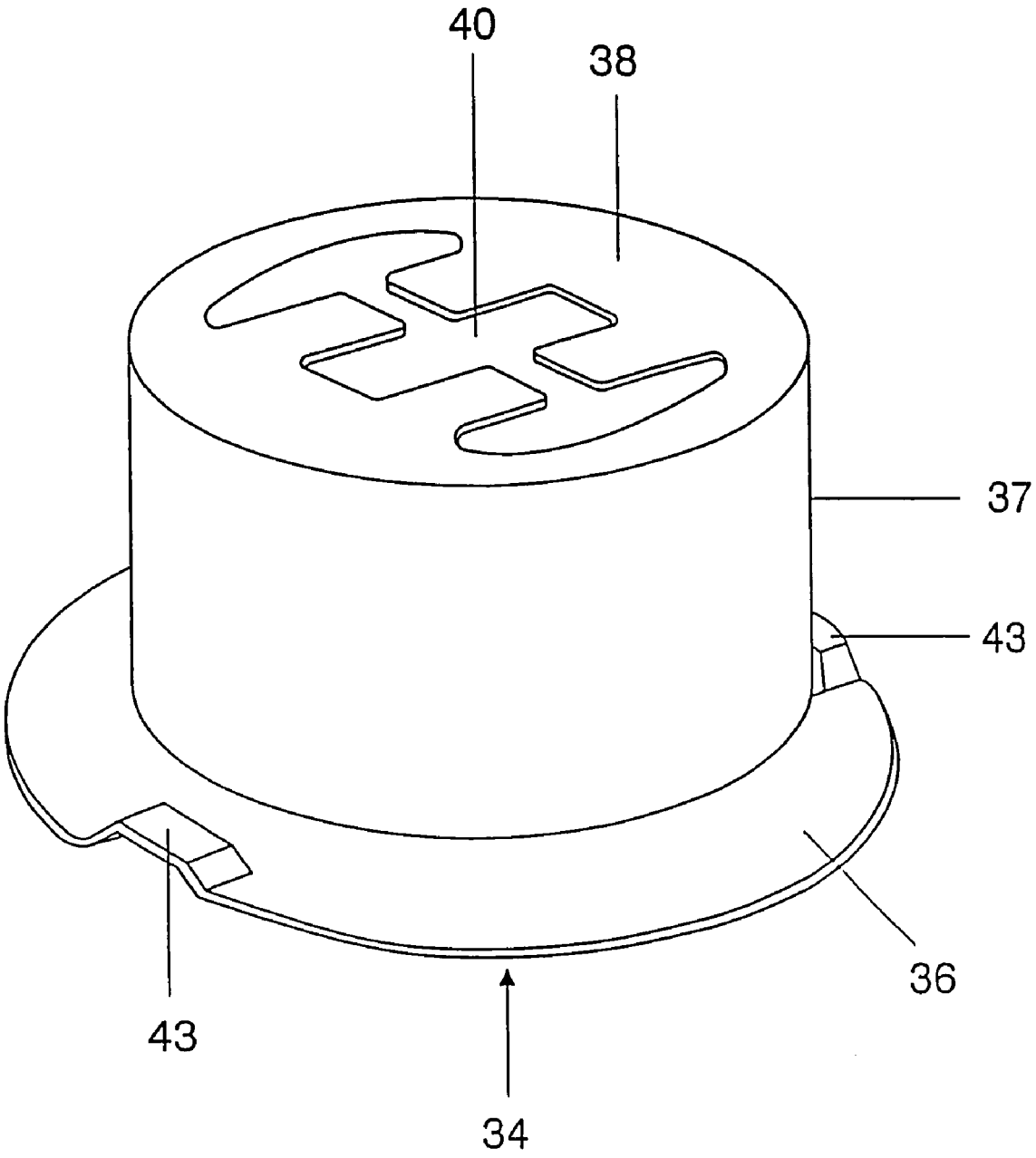
FIG. 6 shows a second embodiment of the main clip.
Figure 7:
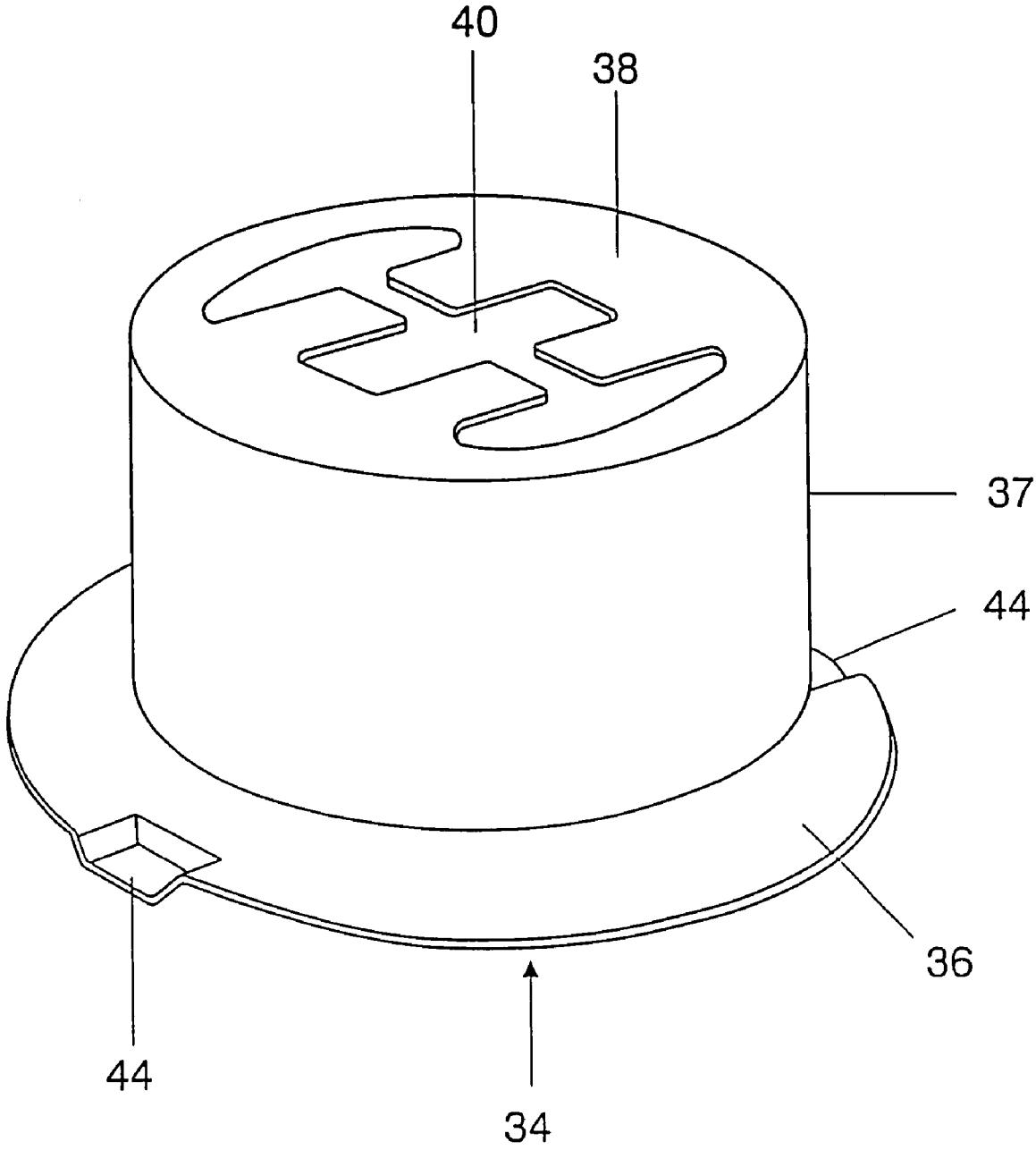
FIG. 7 shows a third embodiment of the main clip.

A different exemplary embodiment of a main clip 34 is shown in FIGS. 6 and 7. It differs essentially from the first exemplary embodiment by the differently constructed anti-twisting means. In FIG. 6, it is formed as a bulge 43. In FIG. 7, it is formed as a dent 44.

Figure 8:
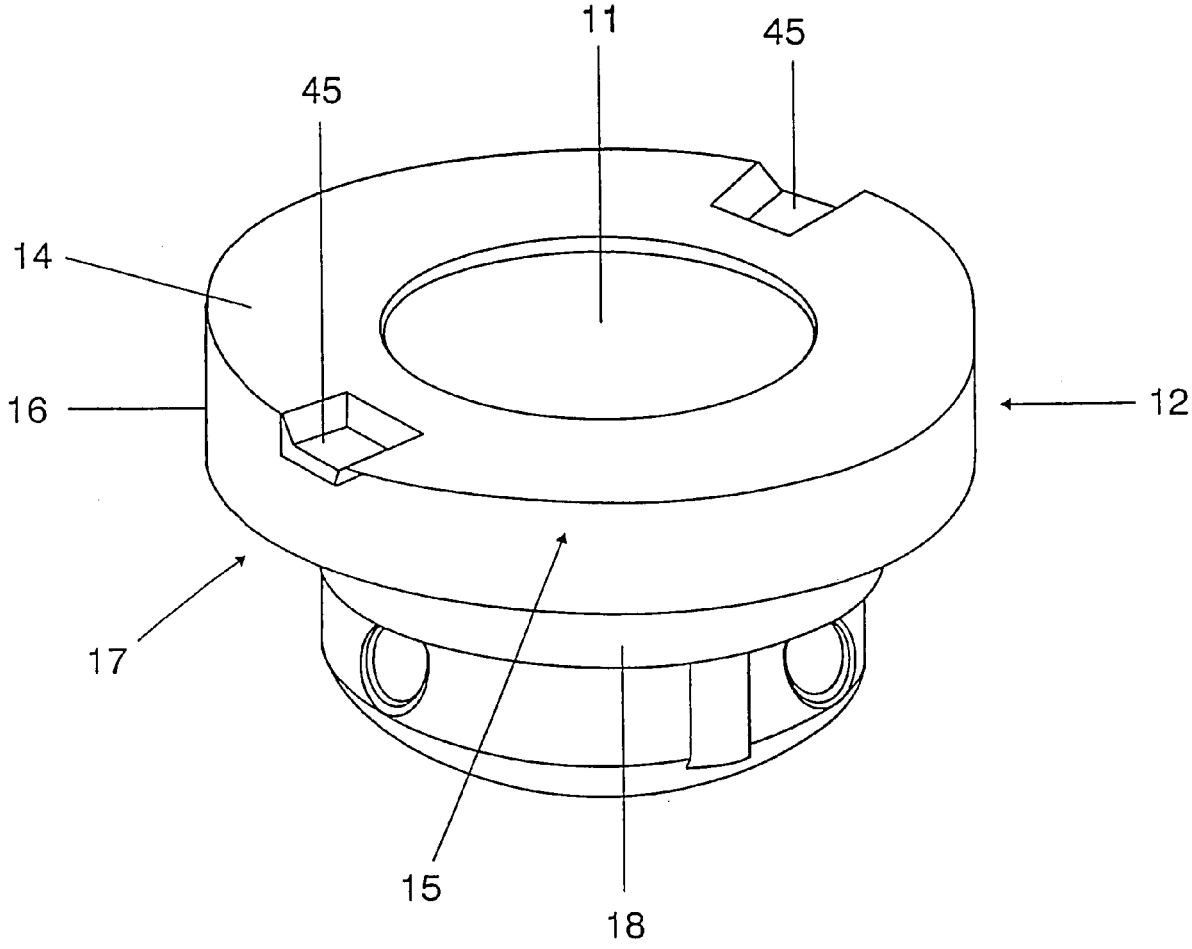
FIG. 8 shows a first exemplary embodiment of a base contact insulator.

In FIG. 8, the base contact insulator belonging to the spring chip 13 is shown. It matches the main clip shown in FIG. 7. The base contact insulator 12 has a central opening 11, and also a disk-shaped or collar-shaped segment 15 with an upper plateau 14 and a lower plateau 17 and the side wall 16. The collar 15 is located on the neck part 18. Essential for understanding the anti-twisting means is the dent 45, which is provided in the upper plateau on two opposite sides of the collar. This dent 45 is identical to the dent 44 on the resilient clip elements, both on the main clip 34 and on the secondary clip 35. As a result, the joined clip elements 34, 35 can also be joined with the base contact insulator 12, in that all three components are respectively arranged with dents 44, 45 aligned in relation to one another. The engagement of the dent 44 of the main clip and of the secondary clip in the dent 45 of the base contact insulator has the effect of preventing them from turning in relation to one another.

Figure 9:
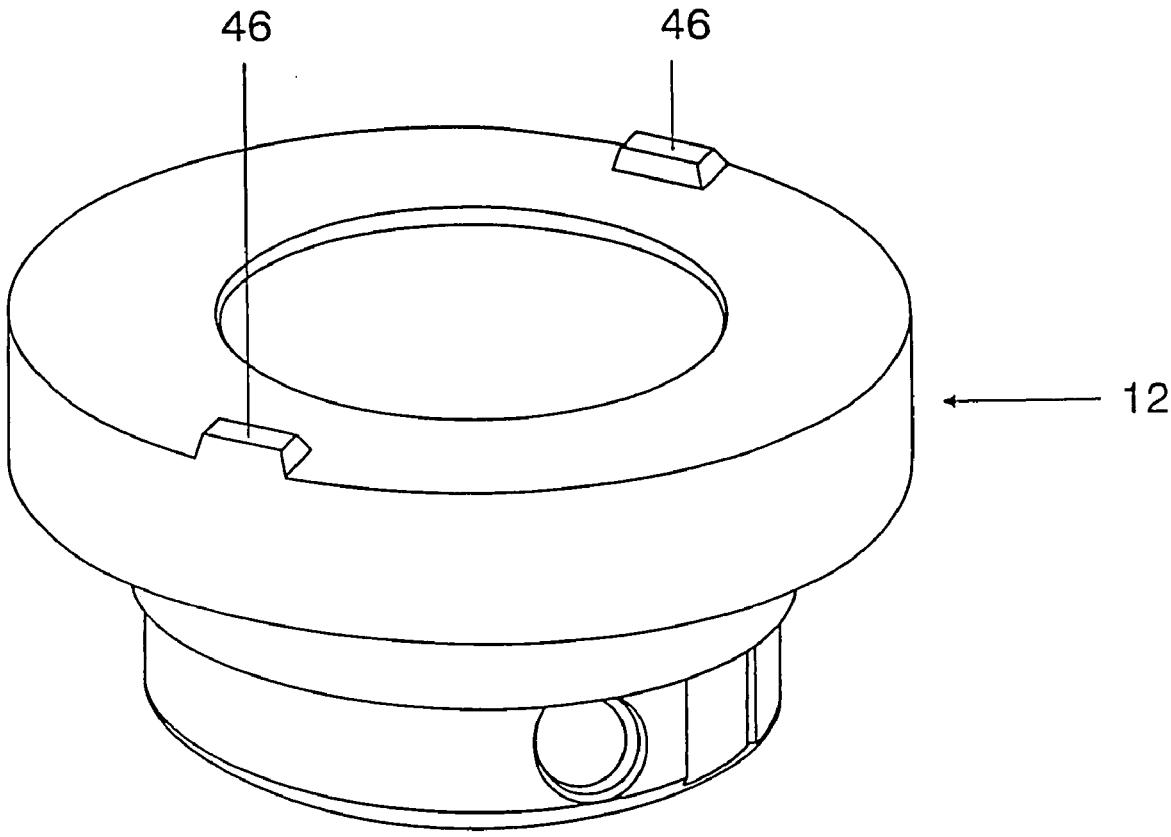
FIG. 9 shows a second exemplary embodiment of a base contact insulator.

FIG. 9 shows a further embodiment of the base contact insulator 12, in which the anti-twisting part is a bulge 46. This bulge 46 is either formed identically to the bulge 43 of the main clip in FIG. 6, so that once again an anti-twisting means which virtually represents the positive equivalent of the solution by means of a negative that is represented in FIG. 8 is realized here. In the case of the bulge, however, an even more simple anti-twisting means can be realized, in that the bulge 46 can interact with the correspondingly adapted clearances 39 from FIGS. 4 and 5. Conversely, the solution with the bulges has the advantage that an non-detachable connection of the resilient clip elements is made easily possible in this way, in that the main clip 34 and the secondary clip 35 are connected to each other in the region of the two bulges 39, for example by laser welding.

Figure 10:
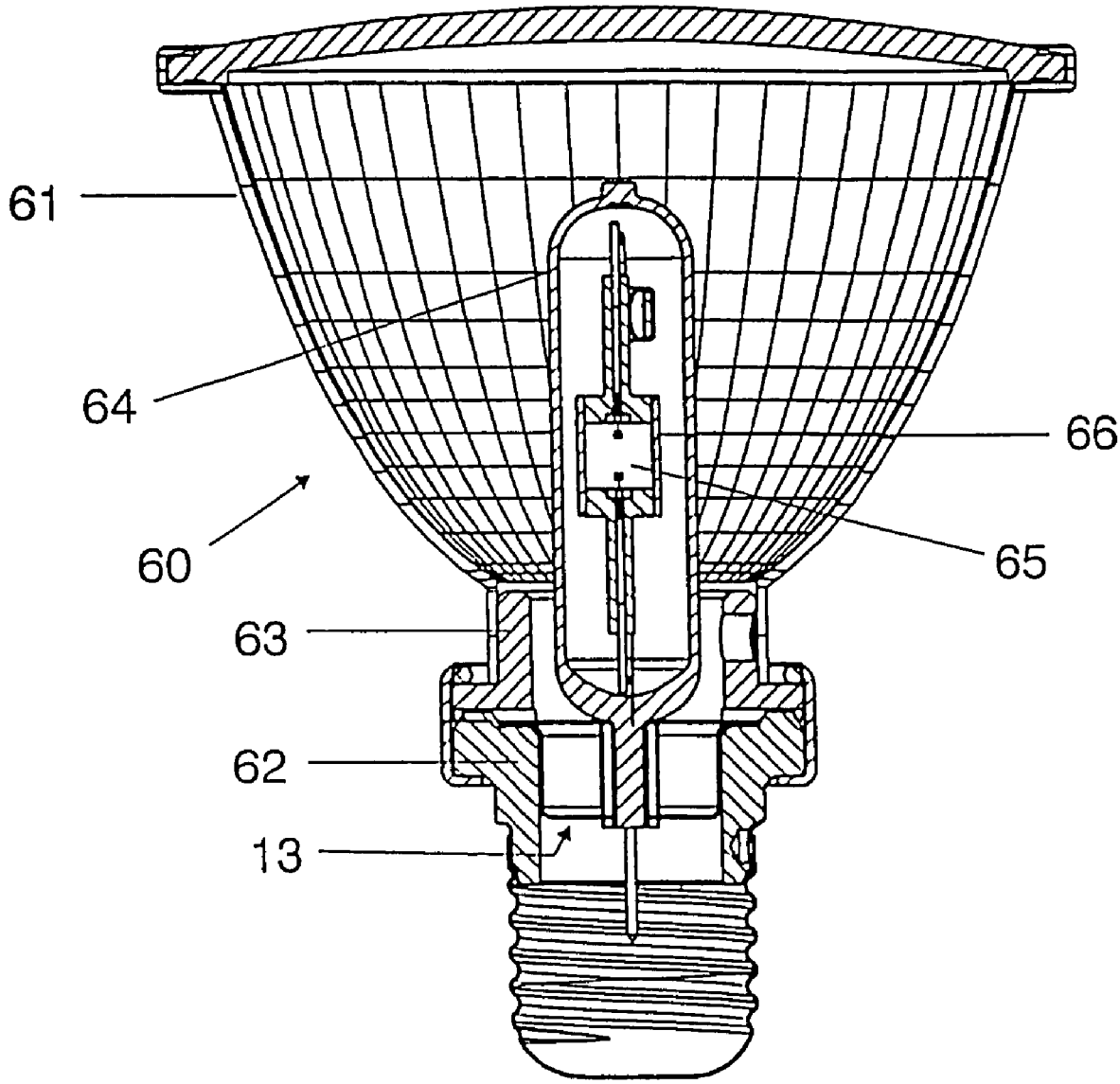
FIG. 10 shows an exemplary embodiment of a reflector lamp.

Shown in FIG. 10 is a reflector lamp 60 with a reflector part 61 as the enveloping part. In this case, the contour of the reflector part 61 is produced from aluminium. Located on the base contact insulator 62 is a separate collar ring 63, which is cylindrically shaped and partly surrounds the outer bulb 64, but ends underneath the discharge volume 65 of the discharge vessel 66. A fastening is realized by crimping. More details on this can be found in PCT/DE2004/001710.

Figure 11:
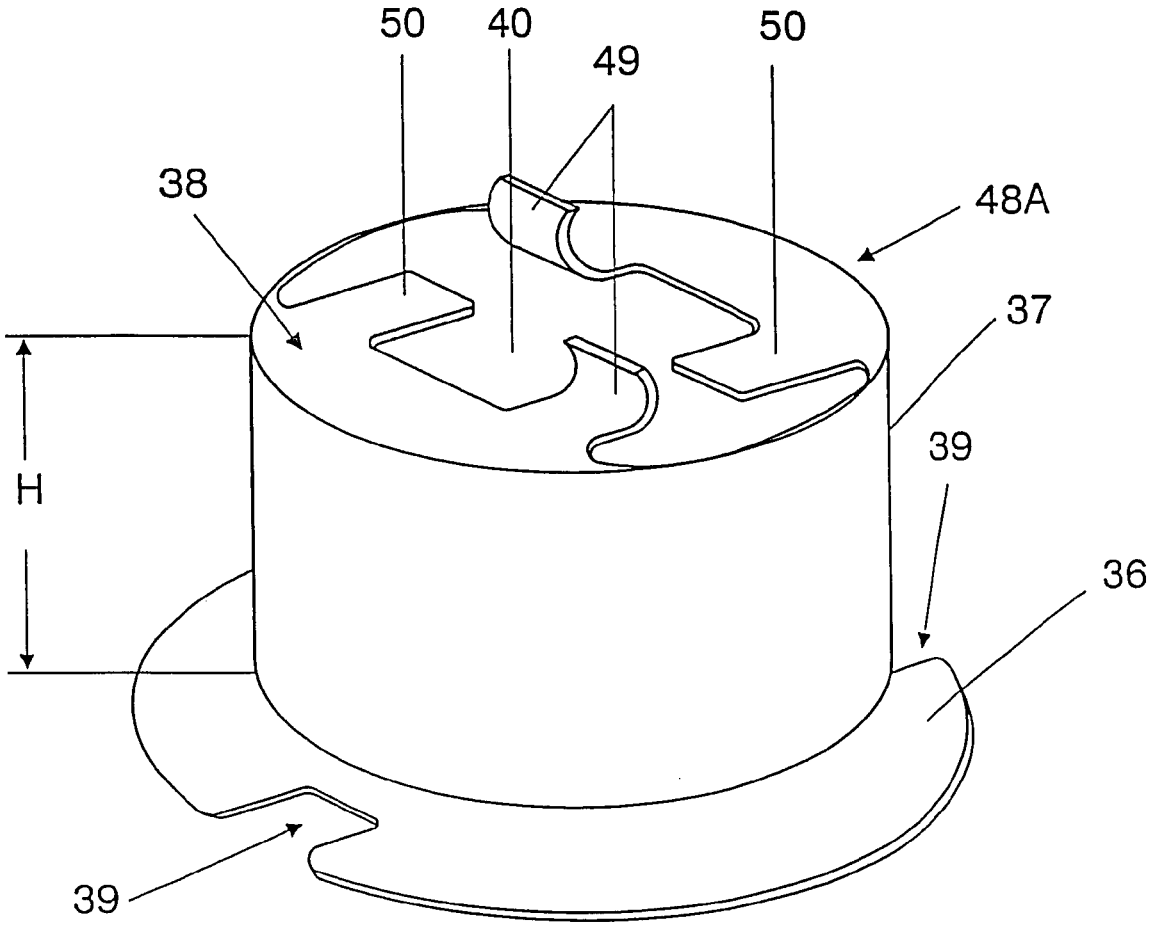
FIGS. 11-14 show further exemplary embodiments of a holding element.

FIG. 11 shows a holding device which merely comprises one element. In this case, the spring clip element 48 has the same construction as the main clip in FIG. 4. The main difference is, however, that the spring tongues are differently bent. While in FIG. 4 the spring tongues are all bent from up to down when the pinch of the lamp bulb is introduced, and therefore a second clip, that is the secondary clip, with a certain distance between the two cover planes is necessary for the guiding and alignment of the lamp bulb, a single clip 48 is sufficient if the lamp bulb is short and if in each case two spring tongues 49 are bent up from the outset, so that they are not bent down when the bulb is introduced. The two other spring tongues 50 are still straight before the bulb is introduced, but may already be bent slightly down in advance to assist. It is recommendable for better axial alignment always to use diametrically opposed spring tongues as identical pairs of spring tongues.

Figure 12A:
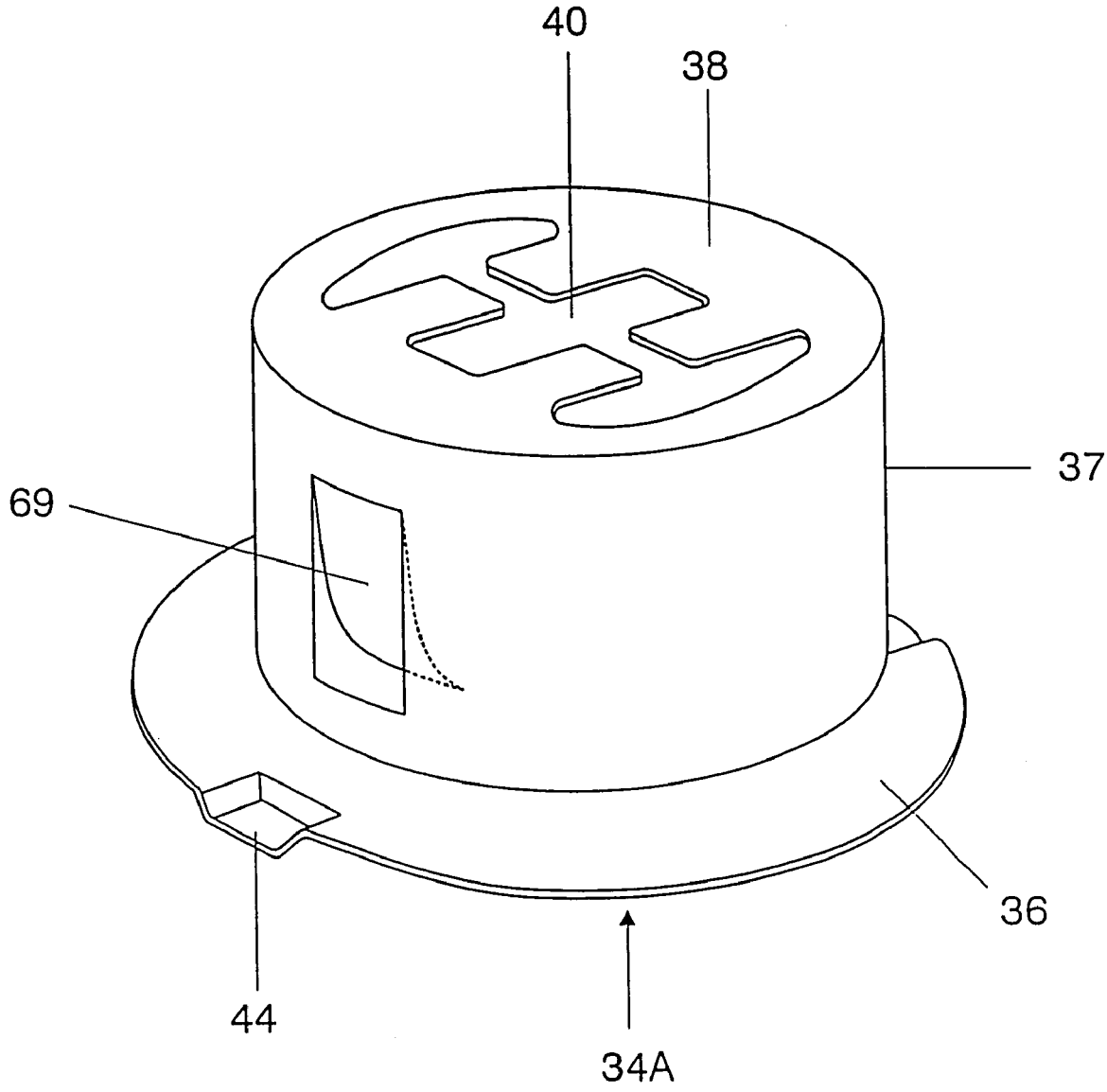

In a particularly simple embodiment of FIG. 12*a*, the function of the main clip and secondary clip is likewise unified in a single spring clip 34A. Here, the clip is in principle configured as a main clip, with the cover 38 as the first holding plane. The second holding plane, which is normally formed by the cover of the secondary clip, is now substituted by elements 69 punched out of the cylindrical part of the clip, that is the side wall 37, and bent to form springs.

Figure 12B:
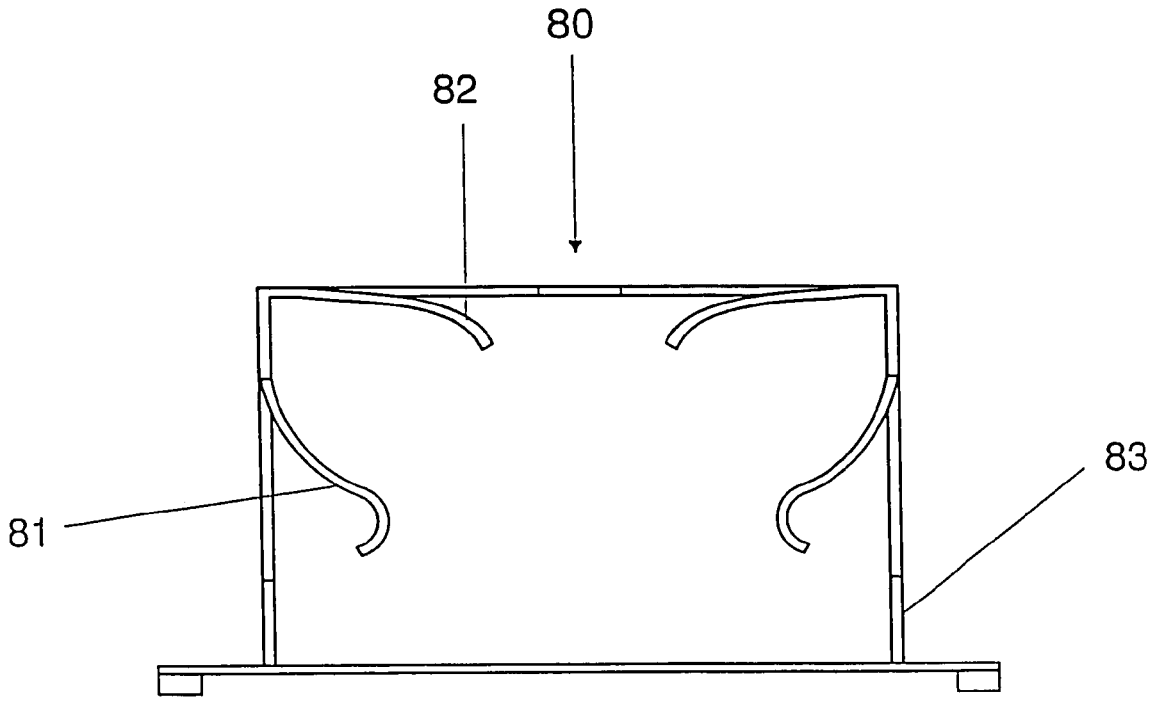

A further embodiment, FIG. 12*b*, is constructed in a very similar way to FIG. 12*a*, but shows a clip 80 in which, as a difference from FIG. 12*a*, the spring elements are elements 81 of the side wall 83 that are bent round once again at their free ends; the spring tongues 82 on the cover are already pre-bent slightly downward.

A single clip may be used on its own if the lamp bulb to be secured is very short. Nevertheless, the use of an anti-twisting means is recommendable here for the fastening to the base contact insulator, even if joining with the secondary clip is not required.

In the case of particularly long lamp bulbs, a second secondary clip may also be used in addition to the first secondary clip.

In all cases with more than one clip element, the dimensions of the clip element are of course to be suitably made to match one another, in particular the diameter of the cylindrical side walls should be slightly different. A slightly conical shape of the side walls, which makes it easier for a number of clip elements to be stacked, is recommendable in particular.

What is claimed is:

1. A lamp assembly comprising;

an envelope having a light transmissive wall forming a shell defining an enclosed volume with an axially extending sleeve portion with an inner wall, the sleeve portion extending to an edge defining an opening;

an electric light source positioned in the enclosed volume, having pinch sealed end with a first electrical lead and a second electrical lead to power the light source, the first lead and the second lead protruding from the sealed end;

a first metal support for the electric light source having the general shape of a cap with a top wall having a cut-out portion sized and shaped to snuggly receive the sealed end of the light source, the sealed end of the light source being snuggly held in the cut-out end, the first metal support further having a side wall with an axial dimension of H and otherwise sized and shape to snuggly fit in the sleeve portion of the envelope, and having at least a flared edge to abut a portion of the envelope edge; and a threaded base sealed to an assembly of the envelop and metal support adjacent the edge pinning the first metal support in the envelope and having a first exterior electrical contact and a second exterior electrical contact, the first lead and the second lead being electrically extended through the first metal support; and the first lead being electrically coupled to the first exterior electrical contact and the second lead being electrically coupled to the second exterior electrical contact, and wherein the first metal support has an axially extending sleeve portion, and the lamp assembly further has a second metal support for the electric light source, the second metal support having the general shape of a cap with a top wall having a cut-out portion sized and shaped to snuggly receive the pinch sealed end of the light source, the pinch sealed end being snuggly held in the cut-out end of the second metal support, the second metal support further having a side wall with an axial dimension less than H and otherwise sized and shape to snuggly fit axially in the sleeve portion of the first metal support, the first lead and the second lead extending through the second metal support and having at least a flared edge to abut a portion of an assembly of the envelope and first metal support.

2. The lamp assembly in claim 1, wherein the at least a flared edge of the second metal support to abut a portion of the edge is a radially extending flange.

3. The lamp assembly in claim 1, wherein the second metal support has an anti-rotational key coupled to a corresponding formed feature on the base.

* * * * *